US010287919B2

(12) United States Patent
Ring et al.

(10) Patent No.: US 10,287,919 B2
(45) Date of Patent: May 14, 2019

(54) LINER LOCK SEGMENT

(71) Applicant: United Technologies Corporation, Hartford, CT (US)

(72) Inventors: Mark David Ring, Cape Neddick, ME (US); Jonathan Earl, Wells, ME (US); Eric Kuehne, Lyman, ME (US)

(73) Assignee: United Technologies Corporation, Farmington, CT (US)

( * ) Notice: Subject to any disclaimer, the term of this patent is extended or adjusted under 35 U.S.C. 154(b) by 584 days.

(21) Appl. No.: 14/431,820

(22) PCT Filed: Feb. 19, 2013

(86) PCT No.: PCT/US2013/026666

§ 371 (c)(1),
(2) Date: Mar. 27, 2015

(87) PCT Pub. No.: WO2014/051666

PCT Pub. Date: Apr. 3, 2014

(65) Prior Publication Data

US 2015/0240663 A1 Aug. 27, 2015

Related U.S. Application Data

(60) Provisional application No. 61/707,710, filed on Sep. 28, 2012.

(51) Int. Cl.
*F01D 25/24* (2006.01)
*F01D 5/32* (2006.01)
(Continued)

(52) U.S. Cl.
CPC ..... *F01D 25/246* (2013.01); *F01D 5/32* (2013.01); *F01D 9/041* (2013.01); *F01D 9/042* (2013.01);
(Continued)

(58) Field of Classification Search
CPC ..... F01D 25/246; F01D 5/32; F01D 9/041; F01D 11/003; F05D 2240/12
See application file for complete search history.

(56) References Cited

U.S. PATENT DOCUMENTS 2,917,276 A 12/1959 Klompas et al.
3,656,822 A 4/1972 Schwartzman
(Continued)

FOREIGN PATENT DOCUMENTS

EP 0353498 A2 2/1990
EP 0531133 A1 3/1993
(Continued)

OTHER PUBLICATIONS

US 7,818,693 B2, 10/2010, Chidambarrao et al. (withdrawn)
Extended European Search Report for EP Application No. 13841894.2, dated Jun. 24, 2016, 7 pages.

*Primary Examiner* — Richard A Edgar
*Assistant Examiner* — Michael L Sehn
(74) *Attorney, Agent, or Firm* — Kinney & Lange, P.A.

(57) ABSTRACT

An assembly includes a first vane pack, a second vane pack, and a liner lock segment. The first vane pack has a plurality of vanes each vane with an airfoil, a platform, and forward and aft mounting hooks. The second vane pack has a plurality of vanes each vane with an airfoil, a platform, and forward and aft mounting hooks. The second vane pack is disposed to abut the first vane pack. The liner lock segment is disposed between the first vane pack and the second vane pack.

15 Claims, 5 Drawing Sheets

(51) Int. Cl.
*F01D 9/04* (2006.01)
*F01D 11/00* (2006.01)

(52) U.S. Cl.
CPC ..... *F01D 11/003* (2013.01); *F05D 2220/32* (2013.01); *F05D 2240/12* (2013.01); *F05D 2240/90* (2013.01); *Y10T 29/49323* (2015.01)

(56) References Cited

U.S. PATENT DOCUMENTS 4,231,066 A 10/1980 Merchant
4,274,805 A 6/1981 Holmes
4,395,195 A 7/1983 De Cosmo et al.
4,747,750 A 5/1988 Chlus et al.
4,889,470 A 12/1989 Scalzo
5,141,395 A 8/1992 Carroll et al.
5,197,856 A * 3/1993 Koertge ..... F01D 25/246 415/199.4
5,265,411 A 11/1993 Belsom
5,318,402 A 6/1994 Bailey et al.
5,323,601 A 6/1994 Jarrell et al.
5,461,866 A 10/1995 Sullivan et al.
5,846,050 A * 12/1998 Schilling ..... F01D 9/04 415/135
5,915,868 A 6/1999 Frazell
6,279,313 B1 8/2001 Lawen, Jr. et al.
6,517,313 B2 2/2003 Rogers
6,637,186 B1 10/2003 Van Duyn
6,692,006 B2 2/2004 Holder
7,258,525 B2 * 8/2007 Boeck ..... F01D 9/042 415/191
7,549,845 B2 6/2009 Uwami et al.
8,186,934 B2 5/2012 Humphries
2004/0169122 A1 9/2004 Dodd et al.
2008/0193290 A1 8/2008 Brackett et al.
2010/0129211 A1 5/2010 Hart et al.
2011/0219784 A1 * 9/2011 St. Mary ..... F01D 5/066 60/805
2012/0076659 A1 3/2012 Robertson
2013/0177401 A1 * 7/2013 Ring ..... F01D 25/04 415/119

FOREIGN PATENT DOCUMENTS

EP 1045959 A1 10/2000
EP 1045959 B1 7/2006
GB 2425155 A 10/2006
GB 2425155 B 9/2007

* cited by examiner

LINER LOCK SEGMENT

BACKGROUND

The present invention relates to gas turbine engines. More particularly, the present invention relates to liner segments for a gas turbine engine.

The operating environment for gas turbine engines is extremely harsh. Vibrations due to normal use at operating speeds are extreme. Additionally, the operating temperature experienced by some engine components is extremely high. Vanes are among the many components that experience wear in the engine due to vibrations and high temperature. Thus, liner segments between the vanes and an engine casing are used to reduce wear. However, current liner segment designs utilize a full ring which is initially mounted within the engine casing. Vanes are inserted into the liner segment and casing one vane at a time, which makes it difficult and time consuming to assemble and disassemble the vanes with the liner segment.

SUMMARY

An assembly includes a first vane pack, a second vane pack, and a liner lock segment. The first vane pack has a plurality of vanes; each vane with an airfoil, a platform, and forward and aft mounting hooks. The second vane pack has a plurality of vanes; each vane with an airfoil, a platform, and forward and aft mounting hooks. The second vane pack is disposed to abut the first vane pack. The liner lock segment is disposed between the first vane pack and the second vane pack.

A gas turbine engine includes a casing, a first vane pack, a second vane pack, and a liner lock segment. The casing includes first and second receptacles therein and, an anti-rotation feature. The first vane pack and the second vane pack are mounted within the first and second receptacles by first and second hooks. Each vane pack abuts the anti-rotation feature. The liner lock segment connects the first vane pack to the second vane pack and is adapted to receive the anti-rotation feature.

A liner lock segment for a gas turbine engine includes a first finger, a second finger, and a lip. The second finger is spaced from the first finger. The lip extends between the first finger and the second finger and includes a curved portion that connects to the first finger and the second finger.

DETAILED DESCRIPTION

The present application discloses a liner lock segment that is adapted to mount to vane assemblies (termed vane packs) and retain the vane assemblies together. Because liner segments described herein are segmented into arcs of less than 360° to facilitate ease of installation and removal of the vane packs within a gas turbine engine, an anti-rotation feature such as a lug is used to keep the vane packs from moving circumferentially with respect to a centerline axis of the gas turbine engine during operation. The liner lock segment includes fingers that overlay standup lugs on the vane packs. The fingers are spaced by a slot that allows the anti-rotation feature to be disposed between and interface with the standup lugs of the vane packs when the vane packs are mounted to the casing.

Figure 1:
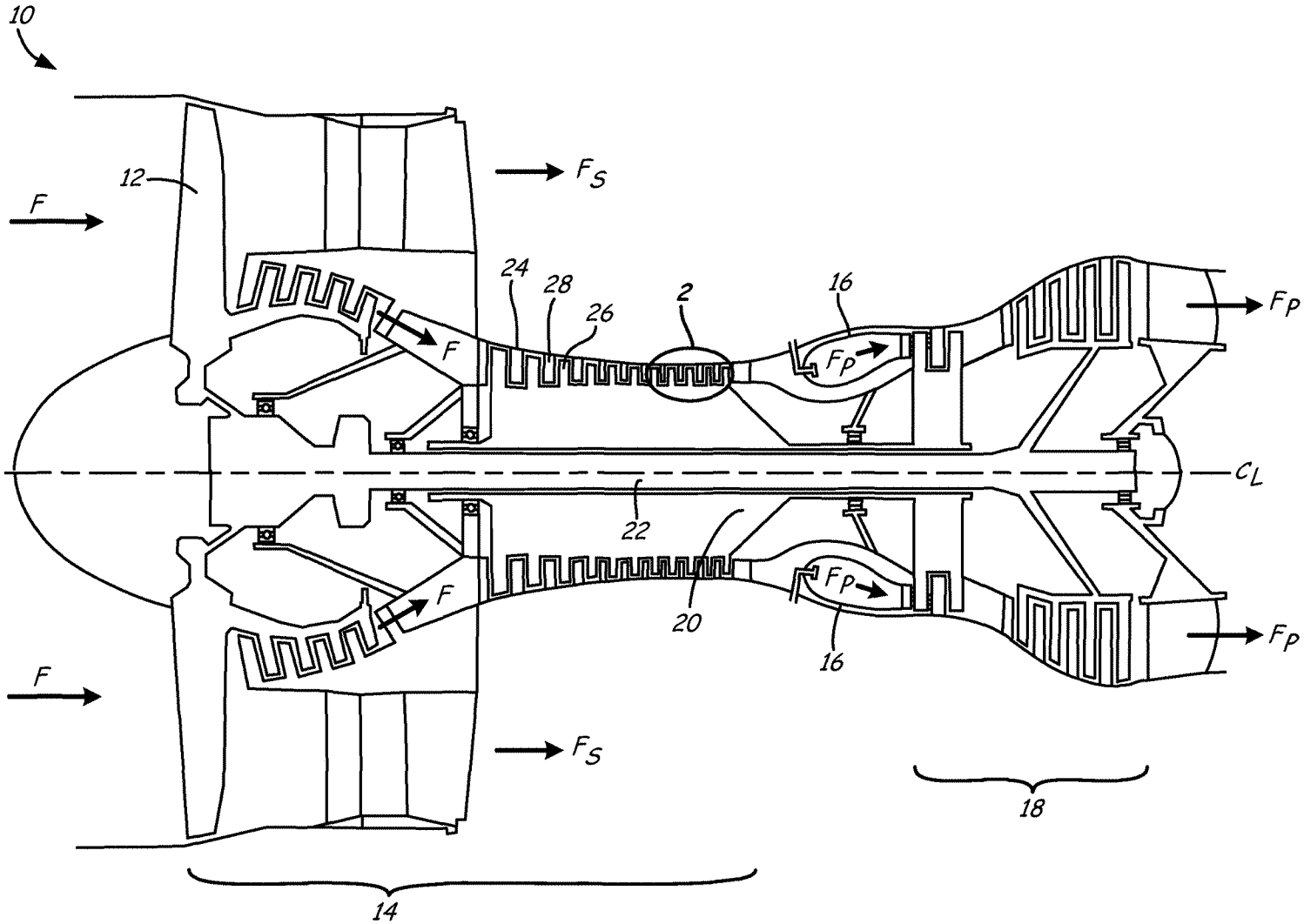
FIG. 1 is a cross-sectional view of a gas turbine engine according to an embodiment of the present invention.

FIG. 1 is a representative illustration of a gas turbine engine 10 including a liner/vane assembly of the present invention. The view in FIG. 1 is a longitudinal sectional view along an engine center line. FIG. 1 shows gas turbine engine 10 including fan blade 12, compressor 14, combustor 16, turbine 18, high-pressure rotor 20, low-pressure rotor 22, and engine casing 24. Compressor 14 and turbine 18 include rotor stages 26 and stator stages 28.

As illustrated in FIG. 1, fan blade 12 extends from engine center line $C_L$ near a forward end of gas turbine engine 10. Compressor 14 is disposed aft of fan blade 12 along engine center line $C_L$, followed by combustor 16. Turbine 18 is located adjacent combustor 16, opposite compressor 14. High-pressure rotor 20 and low-pressure rotor 22 are mounted for rotation about engine center line $C_L$. High-pressure rotor 20 connects a high-pressure section of turbine 18 to compressor 14. Low-pressure rotor 22 connects a low-pressure section of turbine 18 to fan blade 12 and a high-pressure section of compressor 14. Rotor stages 26 and stator stages 28 are arranged throughout compressor 14 and turbine 18 in alternating rows. Thus, rotor stages 26 connect to high-pressure rotor 20 and low-pressure rotor 22. Engine casing 24 surrounds turbine engine 10 providing structural support for compressor 14, combustor 16, and turbine 18, as well as containment for air flow through engine 10.

In operation, air flow F enters compressor 14 after passing between fan blades 12. Air flow F is compressed by the rotation of compressor 14 driven by high-pressure turbine 18. The compressed air from compressor 14 is divided, with a portion going to combustor 16, a portion bypasses through fan 12, and a portion employed for cooling components, buffering, and other purposes. Compressed air and fuel are mixed and ignited in combustor 16 to produce high-temperature, high-pressure combustion gases Fp. Combustion gases Fp exit combustor 16 into turbine section 18.

Stator stages 28 properly align the flow of air flow F and combustion gases Fp for an efficient attack angle on subsequent rotor stages 26. The flow of combustion gases Fp past rotor stages 26 drives rotation of both low-pressure rotor 20 and high-pressure rotor 22. High-pressure rotor 20 drives a high-pressure portion of compressor 14, as noted above, and low-pressure rotor 22 drives fan blades 12 to produce thrust Fs from gas turbine engine 10.

Although embodiments of the present invention are illustrated for a turbofan gas turbine engine for aviation use, it is understood that the present invention applies to other aviation gas turbine engines and to industrial gas turbine engines as well. These include three spooled engines as well as two spooled engines with fan drive gear systems.

Figure 2:
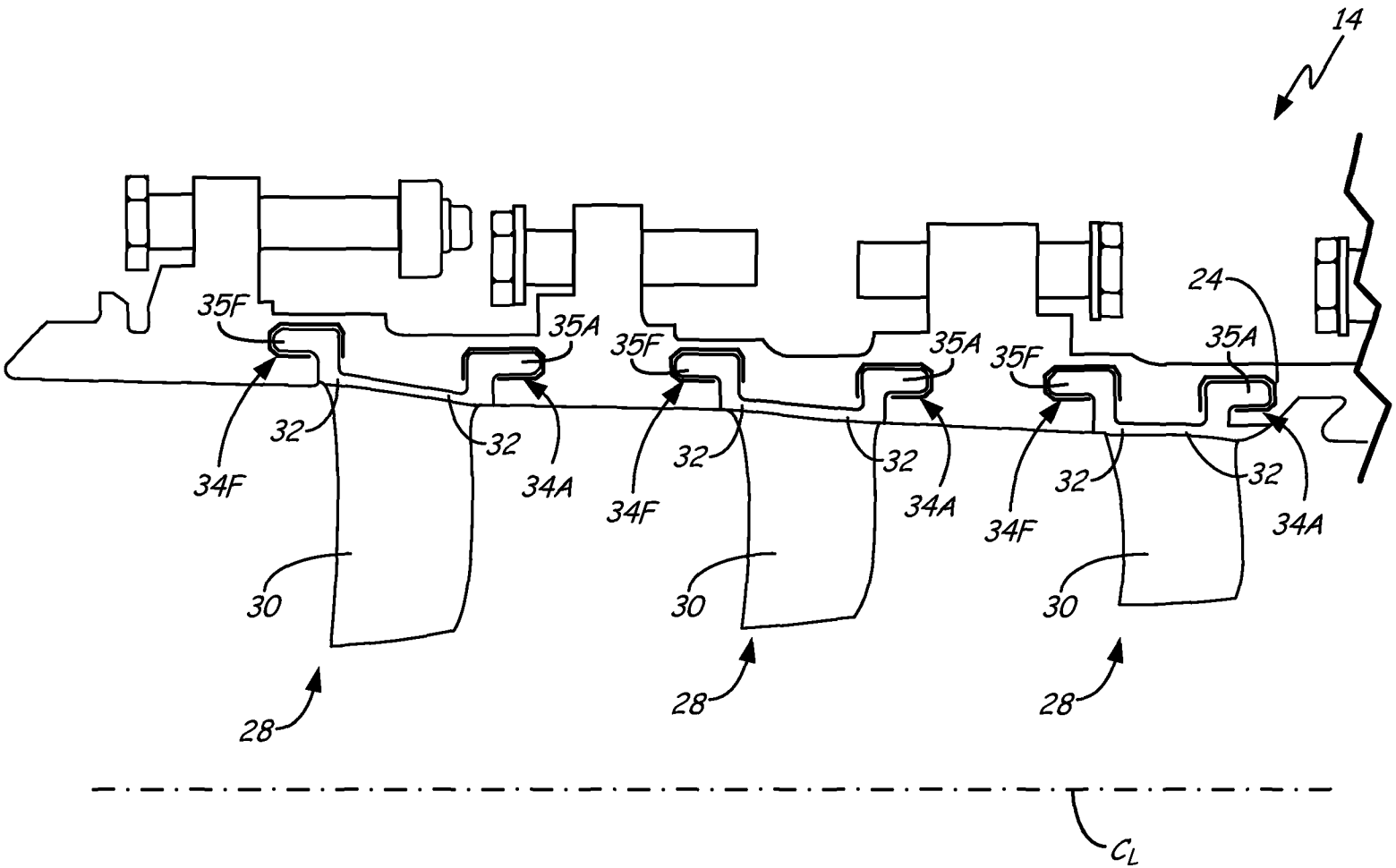
FIG. 2 is a cross-sectional view of one embodiment of a gas turbine engine compressor casing with a plurality of stator stages mounted therein.

FIG. 2 shows an exemplary portion of engine case 24 surrounding compressor 14. In addition to casing 24, FIG. 2 illustrates three stator stages 28 but does not illustrate rotor stages 26 (FIG. 1). Each stator stage 28 includes vane 30 with platform 32. Forward liner segments 34F and aft liner segments 34A are disposed between vanes 30 and casing 24.

Each stator stage 28 is comprised of a circumferential array of a plurality of vanes 30. Stator stages 28 are axially spaced from one another with respect to centerline axis $C_L$ of gas turbine engine 10 (FIG. 1). As shown in FIG. 2, vanes 30 comprise cantilevered vanes which extend radially inward from platforms 32 toward centerline axis $C_L$. In other embodiments, vanes 30 may be supported from both radial ends (with respect to centerline axis $C_L$) and vanes 30 may be disposed in other sections of gas turbine engine 10 such as turbine 18 (FIG. 1).

As will be discussed subsequently, platforms 32 are adapted with hooks that are disposed within casing 24 to allow vanes 30 to be supported therefrom. Forward and aft liner segments 34F and 34A are disposed between the casing 24 and platforms 32. Forward and aft liner segments 34F and 34A dampen vibration between vanes 30 and casing 24, accommodate thermal growth between platform 32 and casing 24, and allow for ease of assembly and disassembly of vanes 30 as a unit.

Figure 3:
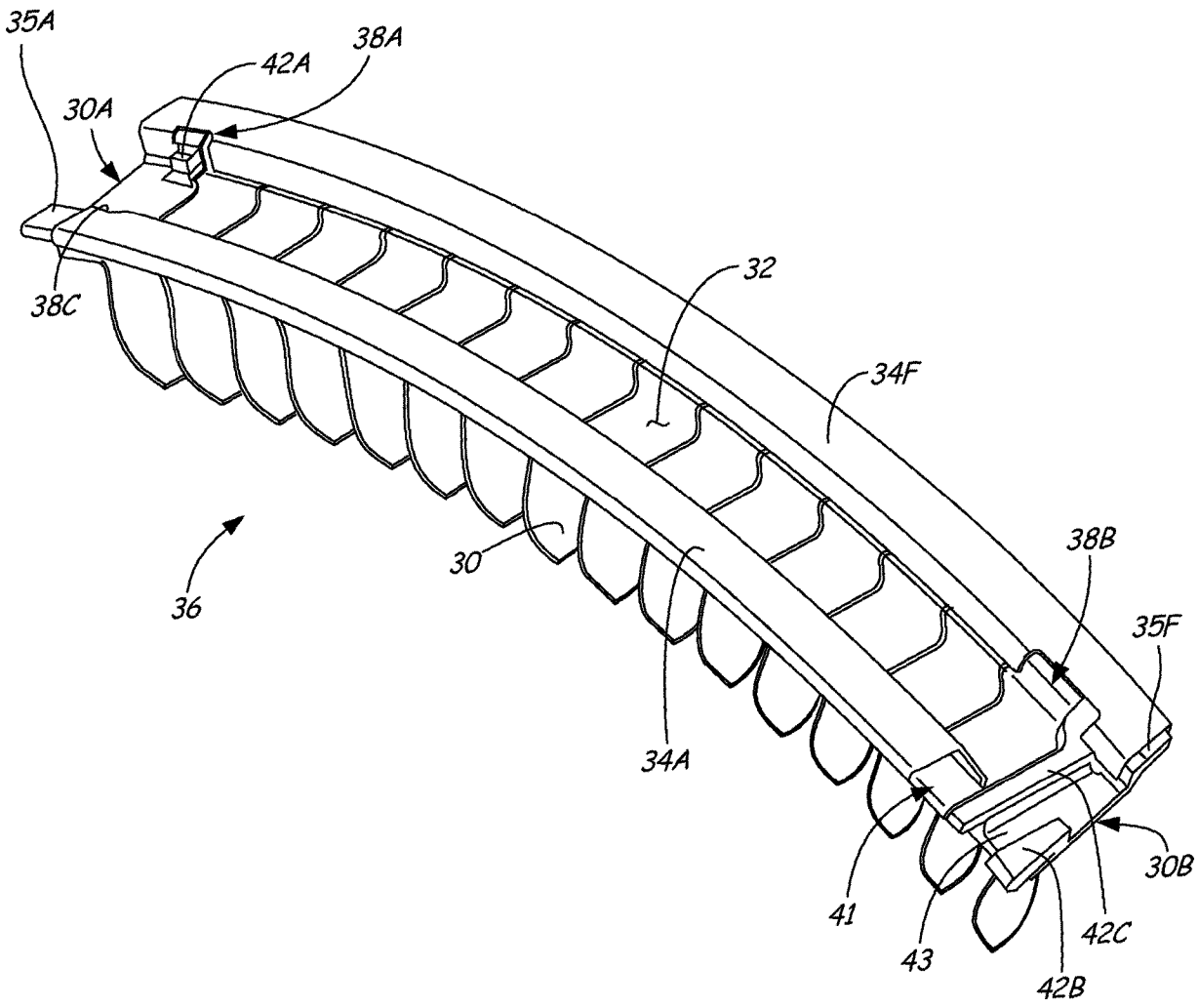
FIG. 3 is a perspective view of one embodiment of a vane pack with forward and aft liner segments mounted thereon.

FIG. 3 shows a plurality of vanes 30 each with platform 32. Vanes 30 are assembled adjacent one another to form vane pack 36. Vanes 30 additionally include forward hooks 35F and aft hooks 35A. Forward liner segment 34F includes slots 38A and 38B. Aft liner segment 34A includes slot 38C. Vane pack 36 includes first end vane 30A and second end vane 30B. First end vane 30A includes first standup 42A. Second end vane 30B includes second standup 42B and third standup 42C. Aft liner segment 34A is spaced from third standup 42C by a slot 41.

Vane pack 36 has of a plurality of adjacent abutting platforms 32 and extends between first end vane 30A at a first end and second end vane 30B at a second end. In the embodiment shown in FIG. 3, vane pack 36 comprises an arc that extends substantially 45° about centerline axis $C_L$ (FIGS. 1 and 2) of gas turbine engine 10 (FIG. 1). In other embodiments, the arc length of vane pack 36 and forward and aft liner segments 34F and 34A can vary in extent.

Aft hooks 35A and forward hooks 35F are disposed on opposing sides of platforms 32. Aft liner segment 34A is mounted to and extends laterally across aft hooks 35A of plurality of vanes 30. Similarly, forward liner segment 34F is mounted to and extends laterally across forward hooks 35F of plurality of vanes 30. Aft liner segment 34A comprises an arcuate segment that extends from first end vane 30A to adjacent second end vane 30B. Thus, aft liner segment 34A is disposed at a distance from second end vane 30B. Forward liner segment 34F comprises an arcuate segment that extends from first end vane 30A to second end vane 30B. As shown in FIG. 3, aft liner segment 34A and forward liner segment 34F comprise single-piece segments that form less than a complete circular ring within the inner circumference of casing 24 (FIGS. 1 and 2).

Slots 38A and 38B in forward liner segment 34F allow forward liner segment 34F to receive and be snap fit to first end vane 30A and second end vane 30B. Slot 38C in aft liner segment 34A allows aft liner segment 34A to receive and be snap fit to first end vane 30A and second end vane 30B. More particularly, slot 38A is adapted to receive and create an interference fit with first standup 42A of first end vane 30A. Slot 38B is adapted to receive and create an interference fit with third standup 42C of second end vane 30B.

Third standup 42C comprises a ridge that extends generally axially from forward hook 35F to aft hook 35A. Second standup 42B forms the aft hook for second end vane 30B and is adapted to abut the aft hook 35A of first end vane 30A when vane pack 36 is assembled adjacent a second vane pack 36.

Third standup 42C and second standup 42B are spaced from one another by slot 43. Slot 43 is adapted to receive anti-rotation feature 49 (FIG. 4B) such as a tab in casing 24 (FIGS. 1 and 2). Anti-rotation feature 49 (FIG. 4B) can engage third standup 42C and/or second standup 42B to provide a stop for vane pack 36 in a circumferential direction when vane pack 36 is installed in casing 24 (FIGS. 1 and 2).

Figure 4A:
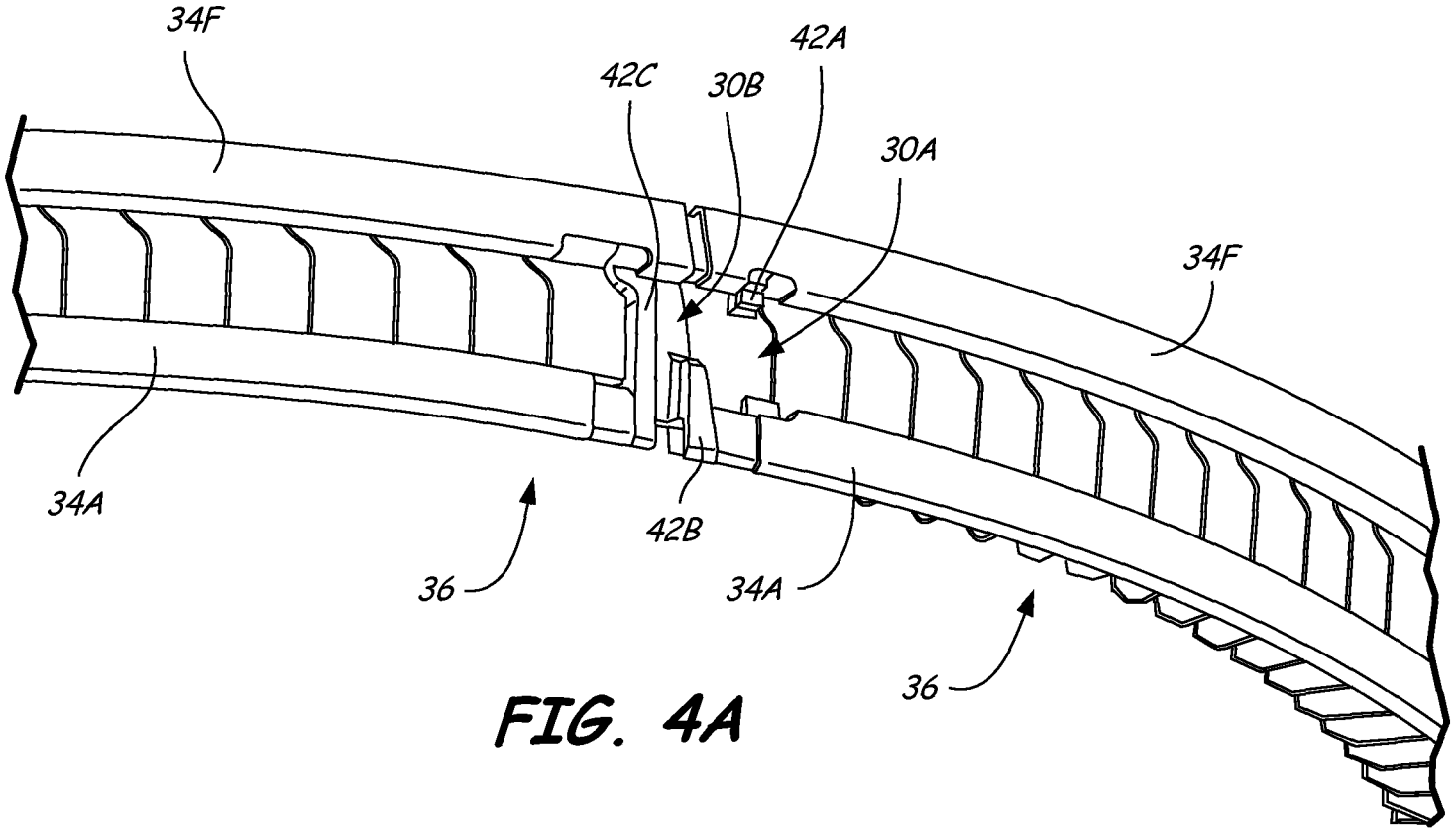
FIG. 4A is a perspective view illustrating an assembly of vane packs and liner segments for installation in gas turbine engine.

In FIG. 4A, casing 24 (FIGS. 1 and 2) is not shown to better illustrate the top of the assembly of vane packs 36 abutting one another. In this arrangement, second vane end 30B of one vane pack 36 abuts first vane end 30A of another vane pack 36 (the plurality of vane packs 36 are arranged circumferentially within casing 24 (FIGS. 1 and 2)). As shown, forward liner segments 34F and aft liner segments 34A comprise arc segments that are spaced from one another. Two or more of both forward liner segments 34F and aft liner segments 34A extend around the interior circumference of casing 24 (FIGS. 1 and 2). Each liner segment 34F and 34A is associated with a single vane pack 36.

Figure 4B:
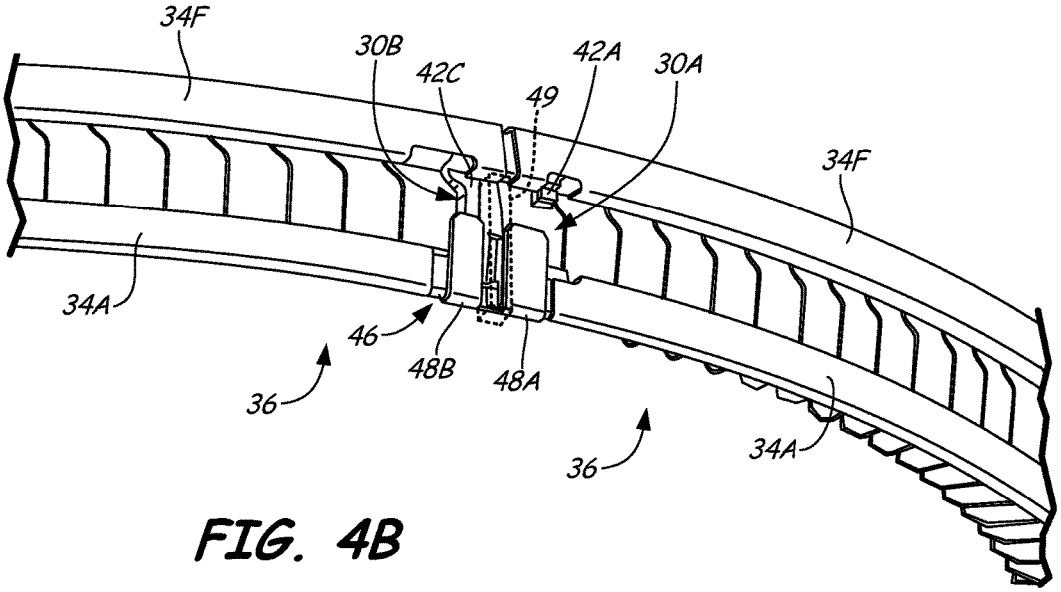
FIG. 4B is a perspective view illustrating an assembly of vane packs and liner segments with a liner lock segment mounted to and extending between the vane packs.

FIG. 4B shows two vane packs 36 with liner lock segment 46 disposed between vane packs 36. Liner lock segment 46 holds vane packs 36 together. Vane packs 36 are arranged to abut one another such that second end vane 30B of one vane pack 36 abuts first end vane 30A of second vane pack 36. The plurality of vane packs 36 are arranged circumferentially within casing 24 (FIGS. 1 and 2). Most of casing 24 is removed in FIG. 4B, however anti-rotation feature 49 is illustrated in phantom disposed between fingers 48A and 48B of liner lock segment 46. In one embodiment, anti-rotation feature 49 can be projection such as a tab or lug. Although anti-rotation feature 49 is described as part of casing 24 (FIGS. 1 and 2) in the exemplary embodiment, in other embodiments anti-rotation feature 49 can comprise a separate component from casing 24.

Fingers 48A and 48B of liner lock segment 46 are spaced from one another and are disposed to overlay aft hooks 35A of vane packs 36. Finger 48B extends over aft hook 35A as well as second standup 42B (FIGS. 3 and 4A). Similarly, finger 48A extends over aft hook 35A as well as third standup 42C. As will be discussed subsequently, liner lock segment 46 is designed with a slot between fingers 48A and 48B in order to allow slot 43 (FIGS. 3 and 4A) to receive anti-rotation feature 49. The slot between fingers 48A and 48B is tightly toleranced to the geometry of anti-rotation feature 49 to reduce slop and the potential for wear. Liner lock segment 46 connects vane packs 36 together and also serves a similar function as forward and aft liner segments 34F and 34A to dampen vibration between vanes 30 and casing 24 (FIG. 2) and accommodate thermal growth between platform 32 and casing 24.

The assembly shown in FIG. 4B can be taken as an assembled unit and inserted into (or removed from) casing 24 (FIGS. 1 and 2). This configuration allows for quicker and easier installation and removal of liner segments 34A and 34F and vanes 30 within gas turbine engine 10 (FIG. 1). As the liner segments 34A and 34F and vane packs 36 are installed and removed as a unit, the assembly also reduces the likelihood of foreign object damage to other components of gas turbine engine 10 (FIG. 1) as the assembly eliminates the need for inserting or removing the vanes 30 from gas turbine engine 10 one vane at a time.

Figure 5:
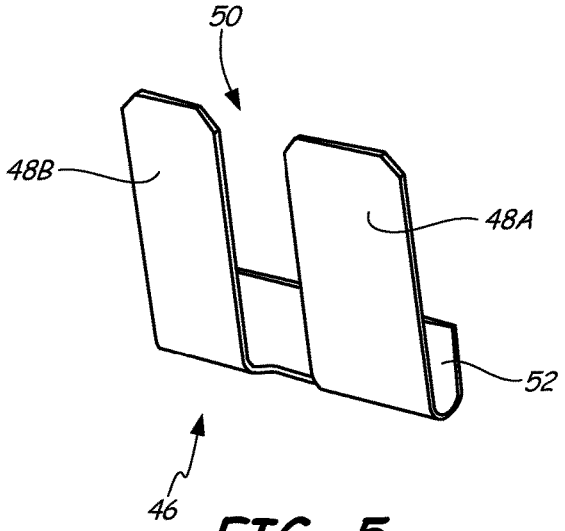
FIG. 5 is a perspective view of one embodiment of the liner lock segment.

FIG. 5 provides a perspective view of liner lock segment 46. Liner lock segment 46 includes fingers 48A and 48B, slot 50, and lip 52. Fingers 48A and 48B are spaced apart by slot 50 and extend from lip 52. Lip 52 comprises a ligament that is adapted to extend over and along aft hooks 35A (FIG. 3)

of adjacent vane packs 36 (FIGS. 4A and 4B). A curved portion of lip 52 connects lip 52 to first finger 48A and second finger 48B. Fingers 48A and 48B extend from lip 52. Fingers 48A and 48B are substantially flat and are constructed of sheet metal in one embodiment.

The present application discloses a liner lock segment that is adapted to mount to vane assemblies (termed vane packs) and retain the vane assemblies together. Because liner segments described herein are segmented into arcs of less than 360° to facilitate ease of installation and removal of the vane packs within a gas turbine engine, an anti-rotation feature such as a lug is necessary to keep the vane packs from moving circumferentially with respect to a centerline axis of the gas turbine engine during operation. The liner lock segment includes fingers that overlay standup lugs on the vane packs. The fingers are spaced by a slot that allows the anti-rotation feature to be disposed between and interface with the standup lugs of the vane packs when the vane packs are mounted to the casing.

Discussion of Possible Embodiments

The following are non-exclusive descriptions of possible embodiments of the present invention.

An assembly includes a first vane pack, a second vane pack, and a liner lock segment. The first vane pack has a plurality of vanes each vane with an airfoil, a platform, and forward and aft mounting hooks. The second vane pack has a plurality of vanes each vane with an airfoil, a platform, and forward and aft mounting hooks. The second vane pack is disposed to abut the first vane pack. The liner lock segment is disposed between the first vane pack and the second vane pack.

The assembly of the preceding paragraph can optionally include, additionally and/or alternatively, any one or more of the following features, configurations and/or additional components:

the first vane pack and the second vane pack include one or more standups and the liner lock segment includes one or more fingers adapted to overlay the one or more standups;

the liner lock segment includes a first finger that overlays the first vane pack and a second finger that overlays the second vane pack;

the liner lock segment includes a lip that extends between the first finger and the second finger, and the lip is adapted to mount on the aft mounting hook of at least one of the plurality of vanes;

the first vane pack and the second vane pack abut one another and define a slot, and the liner lock segment is disposed to overlay the slot;

the liner lock segment includes a slot that interfaces with the slot of the first vane pack and the second vane pack;

an anti-rotation feature disposed between the first vane pack and the second vane pack and received by the slot of the liner lock segment; and the plurality of vanes comprise cantilevered vanes.

A gas turbine engine includes a casing, a first vane pack, a second vane pack, and a liner lock segment. The casing includes first and second receptacles therein and, an anti-rotation feature. The first vane pack and the second vane pack are mounted within the first and second receptacles by first and second hooks. Each vane pack abuts the anti-rotation feature. The liner lock segment connects the first vane pack to the second vane pack and is adapted to receive the anti-rotation feature.

The gas turbine of the preceding paragraph can optionally include, additionally and/or alternatively, any one or more of the following features, configurations and/or additional components:

the first vane pack and the second vane pack include one or more standups and the liner lock segment includes one or more fingers adapted to overlay the one or more standups;

the liner lock segment includes a first finger that overlays the first vane pack and a second finger that overlays the second vane pack;

the anti-rotation feature is received by a slot between the first finger and the second finger of the liner lock segment;

the liner lock segment includes a lip that extends between the first finger and the second finger;

the first vane pack and the second vane pack abut one another and define a slot that receives the anti-rotation feature; and the plurality of vanes comprise cantilevered vanes.

A liner lock segment for a gas turbine engine includes a first finger, a second finger, and a lip. The second finger is spaced from the first finger. The lip extends between the first finger and the second finger and includes a curved portion that connects to the first finger and the second finger.

The liner lock segment of the preceding paragraph can optionally include, additionally and/or alternatively, any one or more of the following features, configurations and/or additional components:

a first vane pack having a plurality of vanes each vane having an airfoil, a platform and forward and aft mounting hooks;

a second vane pack having a plurality of vanes each vane having an airfoil, a platform, and forward and aft mounting hooks, wherein the second vane pack is disposed to abut the first vane pack, the liner lock segment is disposed between the first vane pack and the second vane pack and the lip is adapted to mount on the aft mounting hook of at least one of the plurality of vanes;

the first finger that overlays the first vane pack and the second finger overlays the second vane pack;

the first vane pack and the second vane pack abut one another and define a slot, and the liner lock segment is disposed to overlay the slot; and the liner lock segment includes a slot that interfaces with the slot of the first vane pack and the second vane pack.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. An assembly comprising:

a first vane pack having a plurality of vanes, each vane having an airfoil, a platform, forward and aft mounting hooks, and a first standup;

a second vane pack having a plurality of vanes, each vane having an airfoil, a platform, forward and aft mounting hooks, and a second standup, wherein the second vane pack is disposed to abut the first vane pack; and a liner lock segment disposed between the first vane pack and the second vane pack, wherein the liner lock segment comprises:

a first finger overlaying one of the aft mounting hooks of the first vane pack;

a second finger spaced from the first finger, the second finger overlaying one of the aft mounting hooks of the second vane pack; and a lip extending between the first finger and the second finger, wherein the lip includes a curved portion that connects the first finger and the second finger, wherein the curved portion of the lip extends around both an aft end of the one of the aft mounting hooks of the first vane pack and an aft end of the one of the aft mounting hooks of the second vane pack.

2. The assembly of claim 1, wherein the first vane pack and the second vane pack abut one another and define a slot, and wherein the liner lock segment is disposed to overlay the slot.

3. The assembly of claim 2, wherein the liner lock segment includes a slot that interfaces with the slot of the first vane pack and the second vane pack.

4. The assembly of claim 3, further comprising an anti-rotation feature disposed between the first vane pack and the second vane pack and received by the slot of the liner lock segment.

5. The assembly of claim 1, wherein the plurality of vanes comprise cantilevered vanes.

6. The assembly of claim 1, wherein the first vane pack further comprises:

a first end vane opposite a second end vane; wherein a first standup is disposed on the platform of the first end vane, and wherein a second stand up and a third standup are disposed on the platform of the second end vane.

7. The assembly of claim 6, wherein the third standup comprises a ridge that axially extends from the forward mounting hook to the aft mounting hook, and the second standup abuts the aft mounting hook of the first end vane when vane packs are assembled adjacent to each other, wherein the first standup and the second standup are spaced from one another by a slot.

8. A gas turbine engine comprising:

a casing with first and second receptacles therein and an anti-rotation feature;

a first vane pack and a second vane pack mounted within the first and second receptacles by first and second hooks, each vane pack abutting the anti-rotation feature, wherein the first vane pack and the second vane pack include a first standup and a second standup respectively; and a liner lock segment connecting the first vane pack to the second vane pack, wherein the liner lock segment further comprises:

a first finger overlaying the first standup;

a second finger spaced from the first finger, the second finger overlaying the second standup; and a lip extending between the first finger and the second finger, wherein the lip includes a curved portion that connects the first finger and the second finger, wherein the curved portion of the lip extends around an end of at least one of the first and second hooks, wherein the liner lock segment receives the anti-rotation feature between the first finger and the second finger.

9. The gas turbine engine of claim 8, wherein the first vane pack and the second vane pack abut one another and define a slot that receives the anti-rotation feature.

10. The gas turbine engine of claim 8, wherein the plurality of vanes comprise cantilevered vanes.

11. A liner lock segment for a gas turbine engine comprising:

a first finger;

a second finger spaced from the first finger, wherein the first finger and the second finger are coplanar; and a lip that extends between the first finger and the second finger, wherein the lip includes a curved portion that connects to the first finger and the second finger, wherein the curved portion is configured to extend around both an end of a mounting hook on a first vane pack and an end of a mounting hook on a second vane pack while the first finger overlays the mounting hook of the first vane pack and the second finger overlays the mounting hook of the second vane pack.

12. An assembly comprising the liner lock segment of claim 11, wherein the assembly further comprises:

a first vane pack having a plurality of vanes each vane having an airfoil, a platform, and forward and aft mounting hooks; and a second vane pack having a plurality of vanes each vane having an airfoil, a platform, and forward and aft mounting hooks, wherein the second vane pack is disposed to abut the first vane pack, wherein the liner lock segment is disposed between the first vane pack and the second vane pack and the lip is adapted to mount on the aft mounting hook of at least one of the plurality of vanes.

13. The assembly of claim 12, wherein the first finger overlays the first vane pack and the second finger overlays the second vane pack and the curved portion of the lip wraps around an aft end of the aft mounting hook.

14. The assembly of claim 12, wherein the first vane pack and the second vane pack abut one another and define a slot, and wherein the liner lock segment is disposed to overlay the slot.

15. The assembly of claim 14, wherein the liner lock segment includes a slot between the first finger and the second finger that interfaces with the slot of the first vane pack and the second vane pack.

* * * * *